US009375596B2

(12) United States Patent
Davis

(10) Patent No.: US 9,375,596 B2
(45) **Date of Patent: *Jun. 28, 2016**

(54) SUSPENSION TRAINING DEVICE

(71) Applicant: THE POWER STRAPS, INC., San Diego, CA (US)

(72) Inventor: Paul G. Davis, San Diego, CA (US)

(73) Assignee: The Power Straps, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/586,424

(22) Filed: Dec. 30, 2014

(65) Prior Publication Data

US 2015/0165254 A1 Jun. 18, 2015

Related U.S. Application Data

(63) Continuation of application No. 12/769,612, filed on Apr. 28, 2010, now Pat. No. 8,920,294, which is a continuation-in-part of application No. 29/350,859, filed on Nov. 24, 2009, now Pat. No. Des. 654,124.

(51) Int. Cl.

| | |
|---|---|
| ***A63B 7/00*** | (2006.01) |
| ***A63B 21/16*** | (2006.01) |
| ***A63B 21/068*** | (2006.01) |

(52) U.S. Cl.

CPC ..... *A63B 7/00* (2013.01); *A63B 21/068* (2013.01); *A63B 21/1663* (2013.01)

(58) Field of Classification Search

CPC ..... A63B 7/00–7/085; A63B 21/00185; A63B 21/002–21/0023; A63B 21/068; A63B 21/1618–21/1663

See application file for complete search history.

(56) References Cited

U.S. PATENT DOCUMENTS

| | | | | |
|---|---|---|---|---|
| 775,989 | A | 11/1904 | Roberts | |
| 1,012,802 | A | 12/1911 | Brogan | |
| 1,374,697 | A | 4/1921 | Heinrich | |
| 1,885,473 | A | 11/1932 | Louis | |
| 3,068,001 | A | 12/1962 | Portman | |
| D262,228 | S | 12/1981 | Docic | |
| D270,262 | S | 8/1983 | Rembe | |
| 4,463,948 | A | 8/1984 | Mohr | |
| 5,178,590 | A * | 1/1993 | Stephens | A63B 7/02 482/23 |
| 5,209,482 | A | 5/1993 | Hopfer | |
| 5,209,712 | A | 5/1993 | Ferri | |
| D343,881 | S | 2/1994 | Wilson | |
| D346,632 | S | 5/1994 | Castellanos | |
| D368,501 | S | 4/1996 | Woodruff | |
| 5,518,486 | A | 5/1996 | Sheeler | |
| D383,810 | S | 9/1997 | Wilkinson | |
| 5,839,994 | A | 11/1998 | Elbogen | |
| 5,871,422 | A | 2/1999 | Elbogen | |

(Continued)

*Primary Examiner* — Oren Ginsberg
*Assistant Examiner* — Jennifer M Deichl
(74) *Attorney, Agent, or Firm* — Mintz Levin Cohn Ferris Glovsky and Popeo, P.C.

(57) ABSTRACT

A suspension training device, system and method for using the same is disclosed. A suspension training device includes an elongated strap, a handle at a first end of the elongated strap, a harness at a second end of the elongated strap, and one or more stops, each stop being affixed at a position along a length of the elongated strap between the handle and the harness. A gravity training system includes two or more suspension training devices. The suspension training devices can be suspending with a stationary object by the stops, such as the elongated strap being threaded between a door and a doorframe, to a desired length to allow a user to accomplish any number of exercises or gravity-resistant movement.

20 Claims, 4 Drawing Sheets

(56) References Cited

U.S. PATENT DOCUMENTS

| | | | | |
|---|---|---|---|---|
| 5,871,424 | A | 2/1999 | Conner | |
| 5,921,903 | A | 7/1999 | Lawrence | |
| D437,623 | S | 2/2001 | Ormsby | |
| 6,450,929 | B1 | 9/2002 | Markham | |
| 6,726,606 | B2 | 4/2004 | Jacobsen | |
| D489,422 | S | 5/2004 | Feder | |
| 6,908,418 | B2 | 6/2005 | Saure | |
| 6,921,354 | B1 | 7/2005 | Shifferaw | |
| 7,007,705 | B1 | 3/2006 | Thrower | |
| 7,223,212 | B2 | 5/2007 | DiOrio et al. | |
| 7,255,666 | B2 | 8/2007 | Cardenas | |
| 7,438,674 | B2 | 10/2008 | Sjodin | |
| 7,651,448 | B2 | 1/2010 | Hetrick | |
| 7,662,073 | B1 | 2/2010 | Baldwin | |
| D616,951 | S | 6/2010 | Imamura | |
| 7,740,570 | B2 | 6/2010 | Winston | |
| 7,762,932 | B2 | 7/2010 | Hetrick | |
| D654,124 | S | 2/2012 | Davis | |
| 8,920,294 | B2 | 12/2014 | Davis | |
| 2002/0022555 | A1 | 2/2002 | Nesci | |
| 2003/0078142 | A1* | 4/2003 | Jacobsen | A63B 21/0552 482/126 |
| 2004/0097349 | A1 | 5/2004 | Rogers | |
| 2006/0052222 | A1* | 3/2006 | Cardenas | A61H 1/0229 482/96 |
| 2007/0066450 | A1 | 3/2007 | Hetrick | |
| 2009/0075787 | A1 | 3/2009 | Hetrick | |
| 2010/0048366 | A1 | 2/2010 | Lebert et al. | |
| 2010/0113235 | A1 | 5/2010 | Calvagne et al. | |
| 2011/0118094 | A1* | 5/2011 | Kissner | A63B 21/0004 482/131 |

* cited by examiner

SUSPENSION TRAINING DEVICE

CROSS REFERENCE TO RELATED APPLICATIONS

This application is a continuation of U.S. patent application Ser. No. 12/769,612, now U.S. Pat. No. 8,920,294, filed on Apr. 28, 2010, titled "Suspension Training Device", which in turn is a continuation-in-part of U.S. Design patent application Ser. No. 29/350,859, now U.S. Pat. No. D654,124, filed on Nov. 18, 2009, entitled, "Portable Travel Exercise Apparatus," the entire disclosure of which is incorporated by reference herein.

BACKGROUND

This document relates to training devices, and more particularly to a training device and system that employs no moving parts and uses suspension against the force of gravity as resistance.

Many devices in the market for training and exercise are complex, expensive, and utilize many moving parts, which can be difficult to operate and maintain. Some training systems today rely on gravity to supply the main force of resistance, and exercises using these systems can be accomplished in relatively close contained areas. However, conventional suspension training devices are difficult to customize either for various users or for various different types of exercises or movements.

SUMMARY

This document presents a suspension training device to enable a user to suspend themselves from an object such as a door or a bar and resist against the force gravity to perform any number of movements and exercises.

In one aspect, a suspension training device includes an elongated strap, a handle at a first end of the elongated strap, and a harness at a second end of the elongated strap. The suspension training device further includes one or more stops, each stop being affixed at a position along a length of the elongated strap between the handle and the harness.

In another aspect, a gravity training system includes at least two suspension straps adapted for suspending a user in resistance against the force of gravity. Each suspension strap includes an elongated strap, a handle at a first end of the elongated strap, a harness at a second end of the elongated strap, and one or more stops affixed at a position along a length of the elongated strap between the handle and the harness. Each stop is configured to connect with a stationary object such as between a door and a doorframe to resist against a force on the elongated strap by the user.

In yet another aspect, a gravity training system includes a pair of suspension straps configured for suspending a user in resistance against the force of gravity. Each suspension strap includes an elongated strap formed by a pair of straps of flexible material connected face-to-face at a number of locations along the length of the elongated strap. Each elongated strap further includes one or more cross-wise openings. Each suspension strap further includes a handle at a first end of the elongated strap, the handle including a cushioned handgrip, and a harness at a second end of the elongated strap and formed of a loop of the elongated strap at the second end, the harness further including a pad supported by the loop, the pad being wider than the elongated strap. Each elongated strap further includes one or more stops, each stop affixed at a position along a length of the elongated strap between the handle and the harness. Each stop is further configured to connect with a stationary object to resist against a force on the elongated strap by the user.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a suspension training device, also called a "gravity training device," and system and method of gravity training which enables a user to suspend his or her body from an object such as a door or a bar and resist against the force gravity to perform any number of movements and exercises. Suspension training performed with the described devices allows counter-gravitational movement, with varying degrees of instability, which better benefits the user during exercise. The suspension training device is lightweight, small and portable, and can be taken anywhere for exercising at any time, by a user of any skill, shape and body type.

Figure 2:
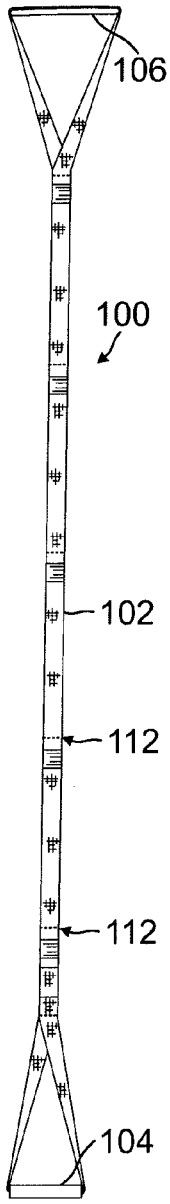
FIG. 2 is a perspective view of a suspension training device.
Figure 3:
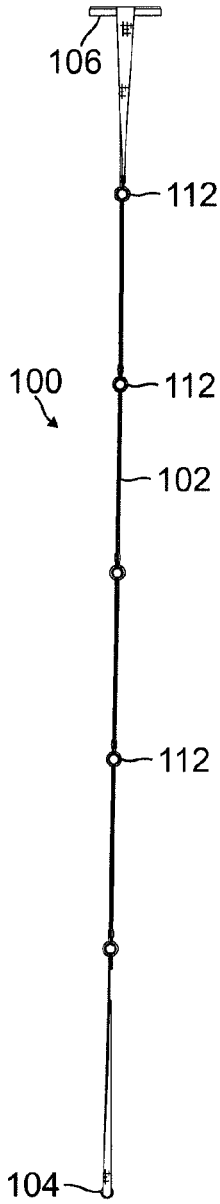
FIG. 3 is a side view of a suspension training device.
Figure 4:
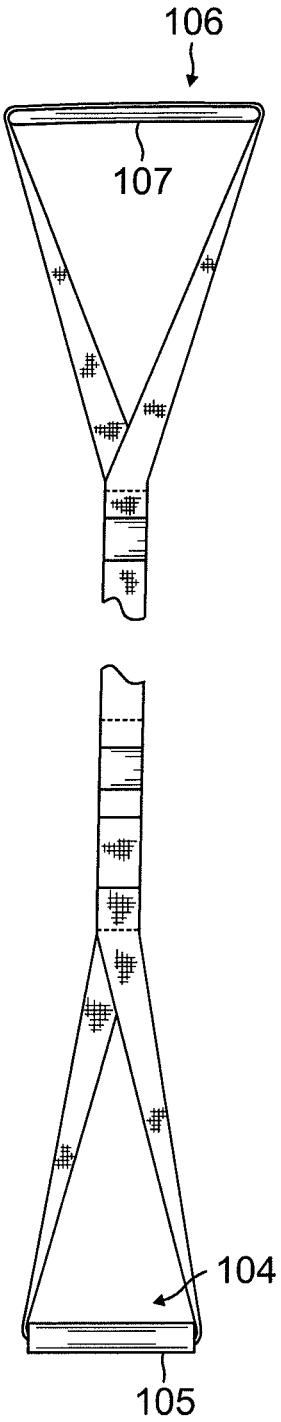
FIG. 4 is a cut-away perspective and detailed view of a suspension training device.

FIG. 2 illustrates a perspective view, and FIG. 3 shows a side view, of a suspension training device 100. FIG. 4 illustrates a cut-away perspective view and FIG. 3 shows a cut-away side view of the suspension training device 100 with greater detail of some of the features of the suspension training device 100. The suspension training device 100 includes a strap 102 having a handle 104 at a first end and a harness 106 at a second end. The strap 102 is preferably an elongated, flat, and flexible strip or band of material, such as a fabric like nylon, polypropylene, polyethylene, polyvinyl, cotton or other fiber having flexibility and high tensile strength. In a particular preferred exemplary implementation, the strap 102 is formed of two strap layers of material mated together by stitching, glue, rivets or other mating mechanisms at locations along the length of the strap 102. A suspension training system can include a pair of suspension training devices 100 for coordinated use by a user to perform various methods and techniques of gravity training.

Figure 5:
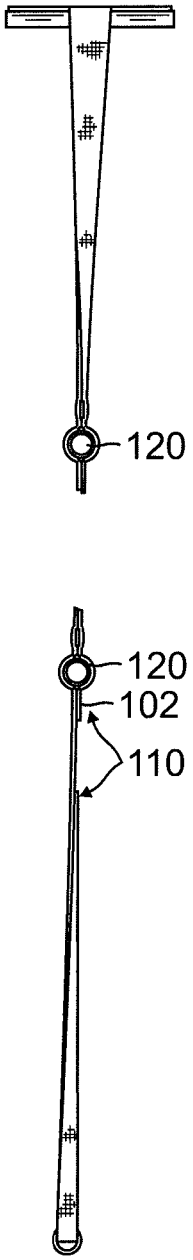
FIG. 5 is a cut-away side view of a suspension training device.
Figure 6:
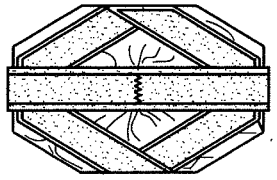
FIG. 6 is a bottom view from below a harness of a suspension training device.
Figure 7:
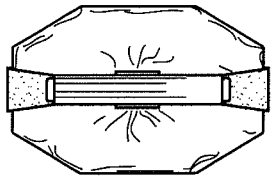
FIG. 7 is a top view from above a handle of a suspension training device.

With reference specifically to FIGS. 4-7, in the preferred implementation, the handle 104 is formed by the first end of the strap 102 being looped back and attached to itself, particularly as illustrated in FIG. 5 and threading a hollow tube 105. In an alternative implementation, the strap 102 can be formed of two separate elongated straps coupled together, and separating out at the first end to attach to opposite sides of the handle 104. The handle 104 can include handgrips or ridges, and may also include a soft outer layer to cushion a user's hand.

The harness 106 includes a pad 107 that is sized and adapted to be able to receive and support a user's foot, knee, arm, upper arm, elbow or other limb or body part. In some configurations, the pad 107 is formed of a cushioning material, and is shaped to widen from narrow ends to a wide midsection. The pad 107 can be supported on an underside by the strap 102 that is cross-stitched on the underside of the pad 107. The strap 102 can also be attached in a truss-type configuration to support the pad 107 on the side of the pad 107 opposite where the user can place his or her limb or body part. In these configurations, the harness 106 can support such limb or body part to enable the user to suspend his or her entire body using leverage provided by the suspension training device 100.

In some implementations, the harness 106 can be formed by a loop of the strap 102 at the second end. The pad 107 can be of any thickness, although it is advantageous to have the pad 107 thickness between 0.25 inch and 1.5 inches, to enable the pad 107 to curve around a limb or body part placed therein, to cradle and stabilize such limb or body part during execution of an exercise. A wide pad 107 also reduces risks of a person catching their head in the harness 106 or being hurt or choked by the strap 102 that forms the harness 106.

In some alternatives, the strap 102 can be formed of one long strap of 10 to 25 feet in length which is looped back on itself and attached at attachment points 110 to form a unitary, double-layered strap, enabling the handle 104 and the harness 106 to be formed from a separation of the two strap layers that is made into an open loop of desired inner dimensions.

The suspension training device 100 further includes a number of stops 112 positioned along the strap 102 at spaced intervals. The spaced intervals can be a uniform measure of spacing, such as every 10 to 24 inches. As shown in FIG. 5, each stop 112 includes a stop mechanism 120 that bulges or protrudes from the thickness of the strap 102, or is coupled on either side by one of two strap layers that make up the strap 102 to provide the bulge or protrusion. In particular implementations, the stop mechanism 120 includes a hollow cylinder glued between two straps that are sewn together on either side of the cylinder, such that the two straps 102 provide a gap for receipt of the hollow cylinder. The use of hollow cylinders can also provide a receptacle for receiving other objects such as cushioning devices, weights, connectors (for connecting a pair of the suspension training devices 100 together), or other objects.

Figure 9A:
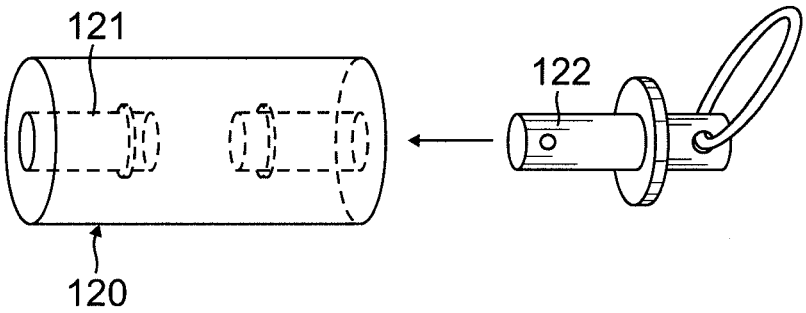
FIG. 9A and FIG. 9B illustrate variations of a connector for a stop or opening within the strap.
Figure 9B:
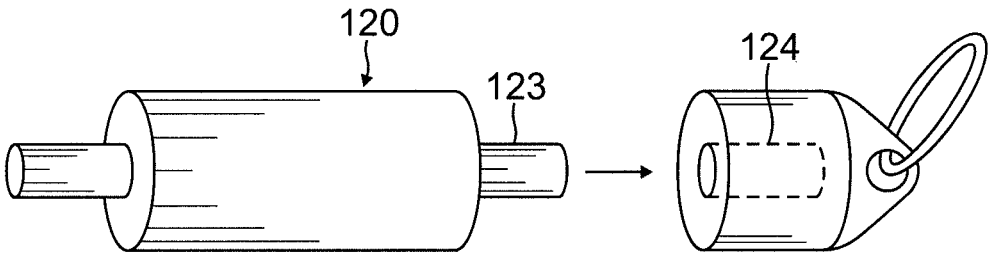

As shown in FIGS. 9A and 9B, in other implementations the stop mechanisms 120 of one or more of the stops 112 are solid and can include a connector for connecting to any number and type of accessories. For example, the connector can include a pin receptacle for receiving a pin attached to an accessory. In another example, the connector can include a pin for connecting to a receptacle on an accessory. The accessory can include a strap, a handle or handgrip, a carabiner, a weight, a pad or padding, an elastic cord, or other device for attachment to the stop 112 to expand the utility of the suspension training device 100.

Figure 1:
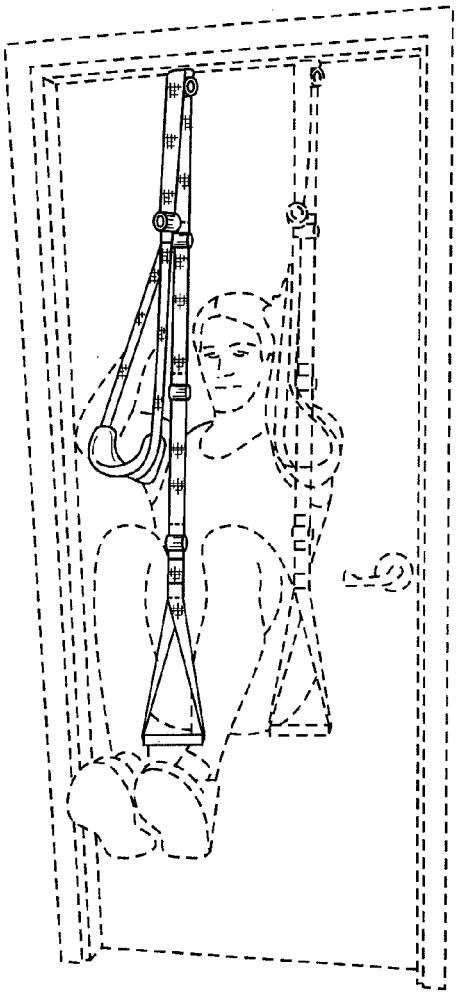
FIG. 1 illustrates a suspension training device in use.

The stops 112 are sized and adapted to inhibit movement of the straps 102 when he suspension training device 100 is placed in a gap between two barriers, such as when slung over a door that is closed within the door frame. As such, a user can tailor the length of each of a pair of suspension training devices 100 that extends out from one side of the barriers for measured length or height, and customized gravity-based resistance. For example, the longer the extension of the straps 102, the greater a user can angle themselves from the upright position, causing greater resistance to pulling themselves up by the handles 104 to accomplish an exercise. As shown in FIG. 1, a user can place their upper arms in the harnesses 106 of a pair of suspension training devices 100, and adjust the height of suspension by adjusting the length of the strap that extends out from a door opposite a selected stop 112.

Each of the stops 112 can include an indicia or number to correlate a stop 112 of one strap 102 with an associated, similarly-positioned stop 112 of another strap 102, when at least two straps 102 are used in a suspension training system. Accordingly, when configuring the length of each of multiple straps 102 that extend from the top of a door or other object, the user can easily and quickly identify and employ stops 112 with corresponding indicia or numbers.

The straps 102 can also include one or more openings 115 within the strap 102 for receiving an object such as a carabiner or other coupling device, particularly for connecting to a stable object other than a door and frame. As such, the one or more openings 115 can be placed proximal to one or more of the stops 112. In one preferred exemplary implementation, on one side of each stop 112, an opening 115 is provided between two strap layers that make up the strap 102, and formed by two tack stitches horizontally across the strap layers. The stitches can be approximately 0.5 inches to 3 or more inches apart, to form the openings 115 to a desired width.

Figure 8A:
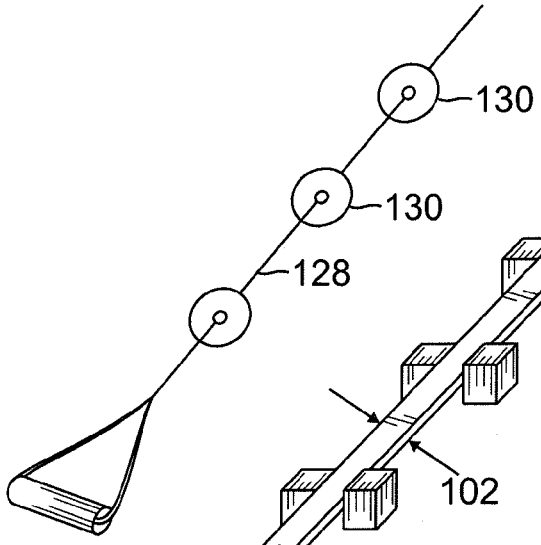
FIG. 8A and FIG. 8B illustrate variations of a strap and stops for use with a suspension training device.
Figure 8B:
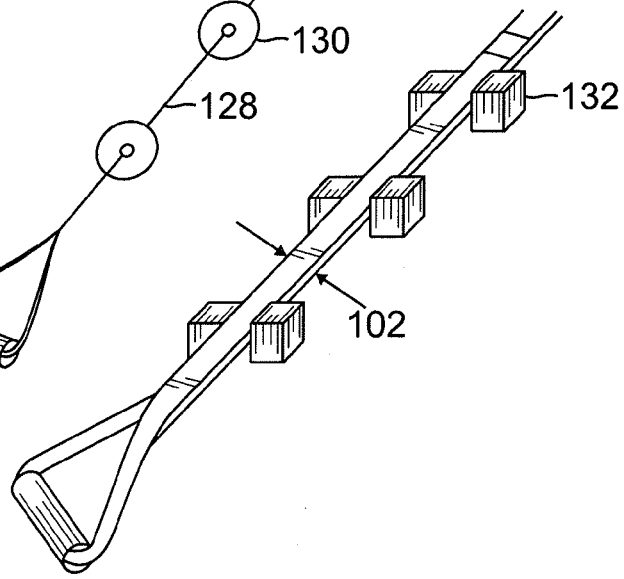

FIGS. 8A and 8B illustrate several variations of a suspension training device 100. FIG. 8A shows a cord 128 formed of string, rope or narrow fabric. The cord 128 threads a number of stops 130 that are of any geometrical shape, such as ball-shaped (spherical), squared, or other shape. The stops 130 can be mounted on the cord 128 at spaced intervals, and secured in place by a knot or other protrusions placed on either side of each stop 130. FIG. 8B shows stops 132 that extend from opposite sides of a strap 102, such as by a small bar that is threaded through a gap in the strap 102, i.e. when two straps 102 are sewn or otherwise attached together to form a unitary strap 102. In this implementation, a large number of gaps formed by the strap 102 can be placed along the length of the suspension training device 100, so as to enable a user to customize the interval length of the stops 132, or to simply place one stop 132 at a particular gap for a desired length of the suspension training device 100 when in use.

Although a few embodiments have been described in detail above, other modifications are possible. Other embodiments may be within the scope of the following claims.

The invention claimed is:

1. A suspension training device comprising:

an elongated strap formed of flexible, inelastic material;

a handle at a first end of the elongated strap configured to receive a first body part of a user, wherein the handle comprises:

a first portion of the elongated strap, wherein the first portion is folded over and fixed to the elongated strap to form a first closed loop; and a hollow tube;

a harness at a second end of the elongated strap configured to receive a second body part of the user, wherein the harness comprises:

a second portion of the elongated strap, wherein the second portion is folded over and fixed to the elongated strap to form a second closed loop;

a flexible pad supported by the second closed loop;

wherein the second closed loop is larger than the first closed loop; and wherein the flexible pad is configured to conform to the second body part of the user and is wider than the hollow tube; and at least two stops, each stop being secured at an interval along a length of the elongated strap between the handle and the harness.

2. The suspension training device in accordance with claim 1, wherein the elongated strap is formed by a pair of straps connected face-to-face at a number of locations along the length of the elongated strap.

3. The suspension training device in accordance with claim 1, wherein the handle at the first end of the elongated strap is configured allow the user to suspend from the handle.

4. The suspension training device in accordance with claim 1, wherein the harness at the second end of the elongated strap is configured to allow the user to suspend from the harness.

5. The suspension training device in accordance with claim 1, wherein the interval is 10 to 20 inches.

6. The suspension training device in accordance with claim 1, wherein the flexible pad is wider than the elongated strap.

7. The suspension training device in accordance with claim 6, wherein the flexible pad is connected and supported on an outside surface by a lattice formed of the elongated strap.

8. The suspension training device in accordance with claim 1, wherein at least one of the at least two stops is formed of a hollow cylinder.

9. The suspension training device in accordance with claim 8, wherein the hollow cylinder is glued between a pair of straps that comprise the elongated strap.

10. The suspension training device in accordance with claim 1, wherein the hollow tube of the handle comprises-a handgrip.

11. A gravity training system comprising:

at least two suspension straps adapted for suspending a user in resistance against the force of gravity, each suspension strap comprising:

an elongated strap formed of flexible, inelastic material;

a handle at a first end of the elongated strap configured to receive a first body part of a user, wherein the handle comprises:

a first portion of the elongated strap, wherein the first portion is folded over and fixed to the elongated strap to form a first closed loop; and a hollow tube;

a harness at a second end of the elongated strap configured to receive a second body part of the user, wherein the harness comprises:

a second portion of the elongated strap, wherein the second portion is folded over and fixed to the elongated strap to form a second closed loop;

a flexible pad supported by the second closed loop;

wherein the second closed loop is larger than the first closed loop;

wherein the flexible pad is configured to conform to the second body part of the user and is wider than the hollow tube; and at least two stops, each stop being secured at an interval along a length of the elongated strap between the handle and the harness.

12. The gravity training system in accordance with claim 11, wherein the elongated strap is formed by a pair of straps connected face-to-face at a number of locations along the length of the elongated strap.

13. The gravity training system in accordance with claim 11, wherein the handle at the first end of the elongated strap is configured allow the user to suspend from the handle.

14. The gravity training system in accordance with claim 11, wherein the harness at the second end of the elongated strap is configured to allow the user to suspend from the harness.

15. The gravity training system in accordance with claim 11, wherein the interval is 10 to 20 inches.

16. The gravity training system in accordance with claim 11, wherein the flexible pad is wider than the elongated strap.

17. The gravity training system in accordance with claim 16, wherein the flexible pad is connected and supported on an outside surface by a lattice formed of the elongated strap.

18. The gravity training system in accordance with claim 11, wherein at least one of the at least two stops is formed of a hollow cylinder.

19. The gravity training system in accordance with claim 18, wherein the hollow cylinder is glued between a pair of straps that comprise the elongated strap.

20. The gravity training system in accordance with claim 11, wherein the hollow tube of the handle comprises a handgrip.

* * * * *